US006985165B2

(12) United States Patent
Terai

(10) Patent No.: US 6,985,165 B2
(45) Date of Patent: Jan. 10, 2006

(54) TONER SCATTERING SUPPRESSING APPARATUS AND IMAGE FORMING APPARATUS

(75) Inventor: Junichi Terai, Yokohama (JP)

(73) Assignee: Ricoh Company, Ltd., Tokyo (JP)

( * ) Notice: Subject to any disclaimer, the term of this patent is extended or adjusted under 35 U.S.C. 154(b) by 272 days.

(21) Appl. No.: 10/188,754

(22) Filed: Jul. 5, 2002

(65) Prior Publication Data

US 2003/0016964 A1 Jan. 23, 2003

(30) Foreign Application Priority Data

Jul. 5, 2001 (JP) ..... 2001-204546

(51) Int. Cl.
*B41J 2/385* (2006.01)
*G03G 9/08* (2006.01)

(52) U.S. Cl. ..... 347/155

(58) Field of Classification Search ..... 347/155, 347/103, 213, 154, 157, 158, 120, 240, 33, 347/34; 399/34, 66, 154, 159, 297, 302, 308, 399/350, 356, 359

See application file for complete search history.

(56) References Cited

U.S. PATENT DOCUMENTS

| | | | | |
|---|---|---|---|---|
| 4,377,334 | A | | 3/1983 | Nishikawa |
| 5,797,074 | A | | 8/1998 | Kasahara et al. |
| 5,950,055 | A | * | 9/1999 | Yahata et al. |
| 6,249,305 | B1 | * | 6/2001 | Miyamoto et al. |
| 6,465,144 | B1 | * | 10/2002 | Hashimoto et al. |

FOREIGN PATENT DOCUMENTS

| | | | |
|---|---|---|---|
| JP | 4-260070 | * | 9/1992 |
| JP | 9-185237 | * | 7/1997 |
| JP | 2001-5365 | * | 1/2001 |

* cited by examiner

*Primary Examiner*—Raquel Yvette Gordon
(74) *Attorney, Agent, or Firm*—Oblon, Spivak, McClelland, Maier & Neustadt, P.C.

(57) ABSTRACT

An image forming apparatus including a developing apparatus for developing a latent image formed on an image bearer by applying toner and a cleaning apparatus for removing the toner remaining on the image bearer after a toner image is transferred to a transfer medium. Also included is a toner scattering prevention apparatus to prevent toner scattering. The toner scattering prevention apparatus includes a pair of substantially similar air filters and is detachably attached to air draining openings respectively formed on the developing and cleaning apparatuses.

18 Claims, 4 Drawing Sheets

TONER SCATTERING SUPPRESSING APPARATUS AND IMAGE FORMING APPARATUS

CROSS-REFERENCE TO RELATED APPLICATION

This application claims priority under 35 USC §119 to Japanese Patent Application No. 2001-204546 filed on Jul. 5, 2001, the entire contents of which are herein incorporated by reference.

BACKGROUND OF THE INVENTION

1. Field of the Invention

The present invention relates to an image forming apparatus, such as a copier, a printer, a facsimile, a combined machine combining these apparatuses, etc. capable of subsequently forming toner images on an image bearer by repeating processes of discharging, writing, developing with dry type developer, transferring images onto transfer members, such as sheets, medium transfer members, etc., and cleaning. More particularly, the present invention relates to a toner scattering suppression apparatus capable of suppressing toner scattering from cleaning and developing apparatuses of the electro-photographic image forming apparatus.

2. Discussion of the Background

In a conventional electro-photographic system using an image forming apparatus, a discharging apparatus uniformly charges a surface of an image bearing member and a writing apparatus and subsequently writes and forms a latent image on the surface by irradiating a light while the image bearing member rotates. Then, a developing device applies toner so as to develop the latent image. The developed toner image is transferred by a transfer apparatus onto a transfer member, such as a sheet, a medium transfer member, etc. Finally, a cleaning apparatus removes toner remaining on the image bearer after image transfer. Then, the image forming apparatus prepares for the next image formation starting from discharging.

However, the rotation of the image bearer and of an internal rotation member cause a rising airflow and an internal air pressure increase in the developing and cleaning apparatuses each accommodating toner. As a result, the airflow leaks from slight gaps in the device at joined parts and toner leakage occurs together with the airflow. Thus, the image forming apparatus is contaminated internally and externally.

Typically, openings are arranged on the developing and cleaning apparatuses to drain air. Air filters are also attached to the openings so as to prevent toner passage and scattering therefrom. However, the air filter can be choked with the toner during usage, and therefore prevention from an increase in internal air pressure is not effective. Thus, dust collection is not effective and toner scattering likely occurs.

Consequently, the air filter requires periodical maintenance. Specifically, the air filter is cleaned by a cleaner or other appropriate substance, or washed to remove toner. Otherwise, the old air filter is replaced with a new filter.

However, two types of air filters are needed in the respective developing and cleaning apparatuses in such a conventional image forming apparatus. As a result, the number of replacement parts increases, and the cost of maintenance rises based on an increase in maintenance inventory.

Further, intervals of maintenance for air filters in the developing and cleaning apparatuses are different from each other in the conventional toner scattering prevention apparatus. Thus, a frequency of maintenance and accordingly an increase in cost results. In such a case, if an air filter with a long maintenance interval receives maintenance at the same time an air filter with a short maintenance interval, changing the long maintenance interval filter is wasteful.

SUMMARY OF THE INVENTION

Accordingly, an object of the present invention is to address and resolve the above-noted and other problems and provide a new image forming apparatus.

The above and other objects are achieved according to the present invention by providing a novel image forming apparatus including a developing apparatus for developing a latent image formed on an image bearer by applying toner thereto, and a cleaning apparatus for cleaning the image bearer while removing the toner remaining on the image bearer after a toner image is transferred to a transfer medium. A toner scattering prevention apparatus is also included to prevent toner scattering. The toner scattering prevention apparatus includes, for example, a pair of substantially similar air filters which are detachably attached to air draining openings formed on the respective developing and cleaning apparatuses.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENT

Figure 1:
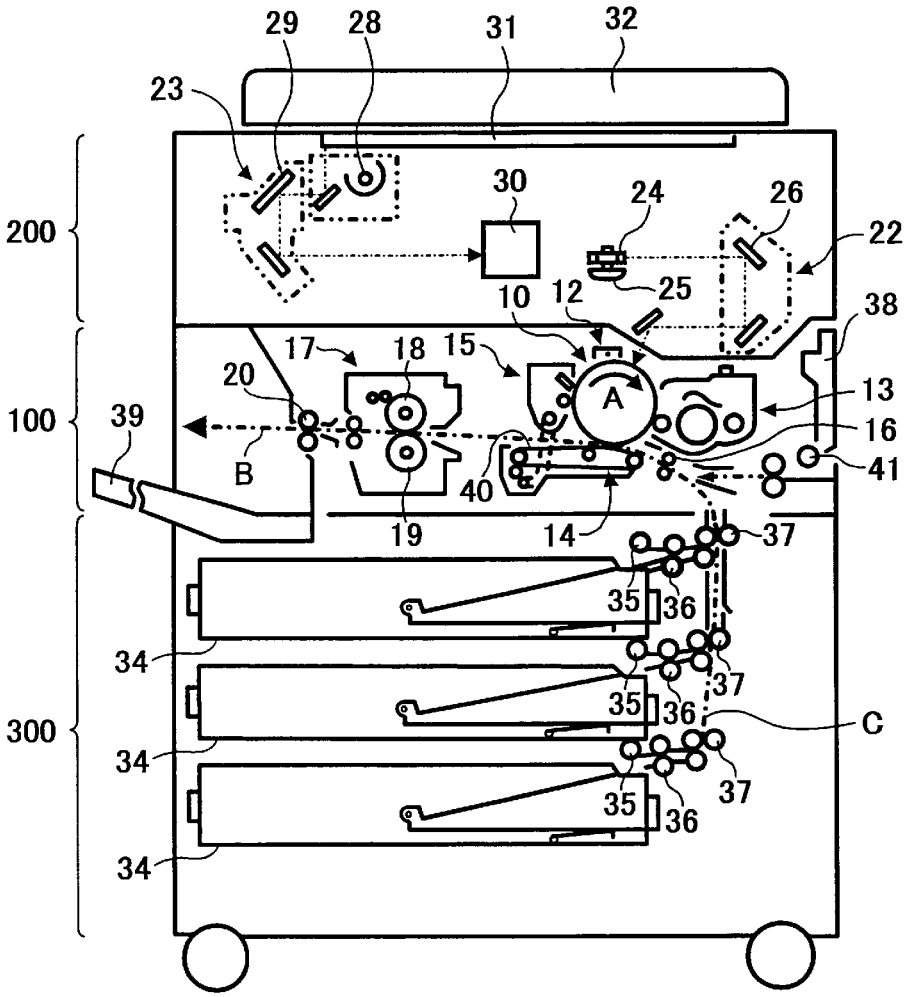
FIG. 1 is a side view illustrating the entire schematic configuration of an interior organization of a digital copier that employs a toner scattering prevention apparatus according to the present invention.

Referring now to the drawings, wherein like reference numerals and marks designate identical or corresponding parts throughout several views, and in particular in FIG. 1, the schematic configuration of an internal organization of a digital copier that includes a toner scattering prevention apparatus according to the present invention is illustrated.

Numeral 100 denotes a copier apparatus body. A reading and writing apparatus 200 may be attached above the copier apparatus body. The copier apparatus body may also be set on a table like sheet bank 300.

As shown, the copier apparatus body 100 includes a drum shaped photo-conductive member (PC member) 10 as an image bearer. An upward charger 12, a developing apparatus 13, a transfer and transportation apparatus 14, a cleaning apparatus 15 and a charge removing apparatus 11 (see FIG. 2) is arranged one after another in this order in a clockwise direction "A" around the photo-conductive member 10.

Also, a sheet transportation path B may be formed in the apparatus body so as to transport a sheet (i.e., a transfer member), such as an OHP film, etc., from right to left in the drawing via a gap formed between the PC member 10 and a transfer and transportation apparatus 14. A register roller 16 is also disposed upstream of the PC member 10 on the sheet transportation path B, and a fixing apparatus 17 is disposed downstream of the PC member 10 along the sheet transportation path B. The fixing apparatus 17 includes a fixing roller 18 with a heater, and a pressure applying roller 19 pressing against the fixing roller 18. An ejection roller 20 is also disposed in a left side of the fixing apparatus 17.

The reading and writing apparatus 200 also includes a laser writing apparatus 22 and a manuscript reading apparatus 23. The laser writing apparatus 22 includes a laser light source (not shown), a polygon mirror 24 for scanning, a polygon motor 25, a scanning optical unit 26 such as an fθ lens. The manuscript reading apparatus 23 includes a light source 28, a plurality of mirrors 29 and an image sensor 30 such as a CCD.

In addition, as shown, an exposure glass 31 is arranged on an upside of the reading and writing apparatus 200. A document cover 32 is attached to the reading and writing apparatus 200 as is openable to cover the exposure glass 31.

Also, the sheet bank 300 includes a plurality of multistage type sheet cassettes 34, in which each sheet cassette 34 includes a supplying roller 35 and a separation roller 36. A sheet feeding passage C is also formed from the right side of the multistage type sheet cassettes 34 to a sheet transportation path B extended in the image forming apparatus body 100. Further, the sheet feeding passage C has a certain number of transportation rollers 37.

As shown, the image forming apparatus body 100 includes an openable and manually sheet feeding tray 38 for guiding a manually inserted sheet to the sheet transportation passage B on the right side surface thereof Further, a sheet ejection tray 39 is attached to the left side surface so as to receive an image-recorded sheet ejected by an ejection roller 20.

When a document is copied, the document cover is open and the document is set onto the exposure glass 31. Then, a start switch (not shown) is depressed. The document reading apparatus 23 is driven and the light source 28 is moved along the exposure glass 31. Simultaneously, a light beam from the light source 28 is reflected by the surface of the document. The reflected light is then reflected by a plurality of mirrors 29 and enters into an image sensor 30, thereby the document is read by the image sensor 30.

In addition, a PC member driving motor (not shown) rotates the PC member 10, and the charger 12 may optionally include a charge roller that uniformly charges the surface of the PC member 10. Subsequently, the laser writing apparatus 22 writes with a laser light in accordance with the contents of the document read by the document reading apparatus 23, so that a latent image is formed on the surface of the PC member 10. Next, the developing apparatus 13 affixes toner thereto, and thus the latent image is formed.

Further, when the start switch is depressed, an appropriate supply roller 35 is rotated, so that some sheets are supplied from a corresponding sheet cassette 34 among the plurality of multistage type sheet cassettes 34. A following separation roller 36 separates and guides sheets one by one to the sheet feeding passage C. The transportation roller 37 transfers and guides the sheet to the sheet feeding passage B. The sheet then collides and stops at the register roller 16. Then, the register roller 16 rotates and feeds the sheet to a section below the PC member in synchronism with rotation of the PC member 10.

Otherwise, the supply roller 41 disposed on the manual sheet feeding section is rotated to bring a sheet manually set on the opening manual sheet inserting tray 38 to the sheet transportation passage B. Then, the register roller 16 similarly feeds the sheet toward the section below the PC member 10 in synchronism with the rotation of the PC member 10.

Subsequently, the transfer and transportation apparatus 14 including a transfer belt 40 transfers a visible image onto the sheet fed to the below section. The cleaning apparatus 15 removes and cleans the toner remaining on the PC member 10 after the image transfer. The charge removing apparatus 11 (see FIG. 2) also removes a potential charge remaining on the PC member 10 in order to prepare for the next image formation started from charging of the charging apparatus 12.

Further, the sheet having received the toner transfer is then fed to the fixing apparatus 17 by the transfer and transportation apparatus 17. The transferred image is then fixed by the fixing apparatus 17 while the fixing and pressure applying rollers 18 and 19 apply heat and pressure thereto. Then, the ejection roller 20 ejects and stacks the sheet on the sheet ejection tray 39.

Figure 2:
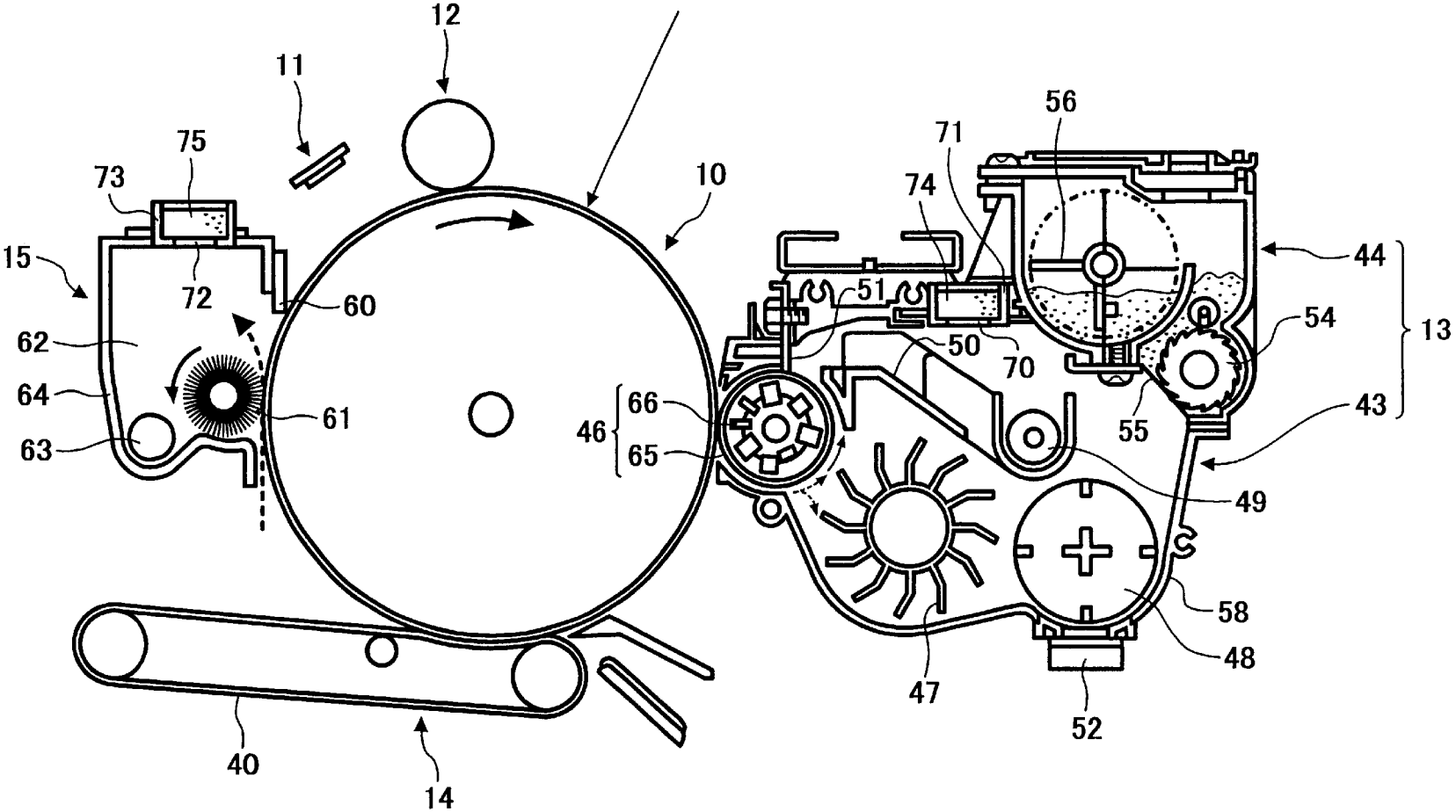
FIG. 2 is a side view illustrating surroundings of a PC drum of FIG. 1.

Referring to FIG. 2, details of the developing apparatus 13 are described. The developing apparatus 13 is formed from a developing tank 43 and a developing hopper 44.

The developing tank 43 includes a developing roller 46, a paddle wheel 47, a stirring roller 48, a transfer screw 49, a separator 50, a doctor blade 51 and a toner density sensor 52, or the like. The developing tank 43 also accommodates two component type developers including at least carrier and toner.

The developing roller 46 includes a cylindrical developing sleeve 65 made of nonmagnetic material, such as aluminum, brass, stainless, conductive plastic, etc. Also, the developing roller 46 may be a magnetic roller member 66 disposed in the developing sleeve 65 so as to form a magnetic field so that the developer can form a bristle on the outer surface of the developing sleeve 65. A rotation driving mechanism (not shown) rotates the developing sleeve 65 counter clockwise.

The developer hopper 44 has a gear such as toner replenishment member 54, a replenishment regulating plate 55 and an agitator 56 or other appropriate apparatuses. The developing hopper 44 also accommodates toner.

Further, the stirring roller 48 rotates and frictionally discharges the two component developer in the developing casing of the developing apparatus 13. The paddle wheel 47 then rotates and chums the developer so that the developer adheres to the developing roller 46. Thus, the magnetic field lines form a chain like bristle made of the carrier on the developing sleeve 65. The charged toner simultaneously sticks to the chain like bristle, thereby forming a magnetic brush.

Then, the magnetic brush is conveyed while the developing sleeve 65 rotates and is regulated to have a prescribed thickness by the doctor blade 51. Specifically, the magnetic brush adheres to the PC member 10 and develops the latent image on the PC drum 10 after the excessive amount is scraped.

When toner decreases as a result of adhesion to the PC member 10 in the developing apparatus 13, a toner rate (i.e., toner density) decreases accordingly. Then, if a toner density of the developer is less than a target value thereof, the agitator 56 rotates and stirs the toner. Simultaneously, the toner is transported to the toner replenishment member 54 and is replenished to the developing tank 43 from the developer hopper 44 while the toner replenishment member 54 is rotated and the replenishment regulating plate 55 is swung. Thus, the toner density can be maintained within a prescribed range.

A toner density sensor 52 may also be attached to the developing casing 58 so as to detect the toner density of the developer. A value obtained by measuring (a density of) a so called "P" pattern (a measurement use toner image) formed on the PC member 10 with a photo sensor can be preset as a toner density target value.

Then, the toner adhering to the PC member 10 is electrostatically transferred onto a sheet by the transfer and transportation apparatus 14 as described above. However, about 10% of the toner remains on the PC member 10 without being transferred. Toner remaining on the PC member 10 is scraped off by the cleaning blade 60 and brush roller 61 disposed in the cleaning apparatus 15 from the PC member 10.

Referring again to FIG. 2, details of the cleaning apparatus are now described. The cleaning apparatus 15 forms a recovery tank 62 in the cleaning casing 64 and includes a cleaning blade 60, a brush roller 61 and a recovery screw 63.

The cleaning blade 60 may be made of rubber, and contact the PC member 10 via its tip with a prescribed pressure and angle. The brush roller 61 may be formed from a metal bar on which brushes are implanted and is rotated by a driving device (not shown) in a direction shown by an arrow in the drawing. The recovery screw 63 may be formed from a metal or plastic mold in a spiral shape.

The brush roller 61 initially scrapes off the toner remaining on the PC member 10 after transfer. Subsequently, the toner surviving the initial scraping operation is almost completely removed by the cleaning blade 60. The toner scraped off from the PC member 10 by the cleaning blade 60 and brush roller 61 then enters into the recovery tank 62. Then, the toner is transferred to one side of the cleaning apparatus 15 by a recovery screw 63.

Further, an air draining use-opening 70 is formed on the developing casing 58 of the developing apparatus 13, and a filter holding frame 71 is arranged around the air draining use-opening 70. Another air draining use-opening 72 is formed in the cleaning casing 64 of the cleaning apparatus 15, and another filter holding frame 73 is arranged around the air draining use-opening 72. As shown, a pair of air filters 74 and 75 have substantially the same shape and material and are detachably attached to the respective filter holding frames 71 and 73. The air filters 74 and 75 may be made from paper, fabric, bonded fiber fabric, or multi porous synthetic plastic, or any other appropriate material, as to remove toner by either physically percolating or using an electrostatic absorption system, or any other appropriate removal system.

When the developing sleeve 65 of the developing roller 46 rotates together with the PC member 10 in the developing apparatus 13, an airflow shown by a dotted line arrow D in FIG. 2 arises in the developing casing 58. However, the airflow leaks through the air draining use opening 70, and the inner air pressure of the developing apparatus 13 does not increase. In addition, floating toner is prevented from leaking from the developing apparatus 13 when trapped by the air filter 74.

Further, when the brush roller 61 rotates together with the PC member 10 in the cleaning apparatus 15, an airflow shown by a dotted line arrow E in FIG. 2 arises in the cleaning casing 64. However, the airflow leaks through the air draining use-opening 72, and the inner air pressure of the cleaning apparatus 15 does not increase. In addition, floating toner is prevented from leaking from the cleaning apparatus 15 when trapped by the air filter 75.

Such internal air pressure is designed to be substantially the same in the respective developing and cleaning casings. In addition, scattering levels in the developing and cleaning casings is also designed to be substantially the same. Thus, because substantially the same material and shape air filters 74 and 75 are used as air draining use openings 70 and 72 in the developing and cleaning apparatuses 13 and 15, parts can be commonly used, and maintenance inventory can be decreased. As a result, the cost of maintenance can be decreased.

If an amount of toner scattering in the developing and cleaning apparatuses 13 and 15 is taken into account and the maintenance interval for respective air filters 74 and 75 are designed to be substantially equal, the respective air filters 74 and 75 can be either cleaned by a cleaner, washed with water or replaced with new ones, at substantially the same time. As a result, the maintenance labor and cost may accordingly decreased.

As illustrated in FIG. 2, when substantially the same air filters 74 and 75 are coupled to air draining use openings 70 and 72 of the respective developing and cleaning apparatuses 13 and 15, and maintenance intervals thereof are designed to be substantially equal, parts may be commonly used, and maintenance inventory may be decreased. In addition, when performance of maintenance occur at substantially the same time, the maintenance labor and cost may be decreased.

Further, if a maintenance interval for at least one of parts of the developing and cleaning apparatuses 13 and 15 is designed to be substantially the same as that of the air filters 74 and 75, and if the maintenance timing for the other parts is substantially the same in addition to that of the respective air filters 74 and 75, the maintenance labor and cost may be further decreased.

Figure 3:
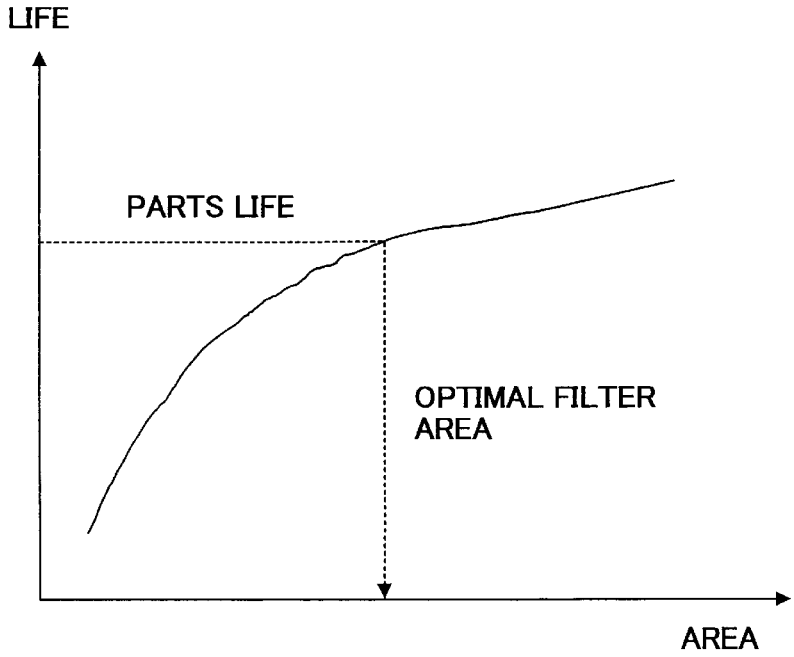
FIG. 3 is a chart illustrating a relationship between an area of an air filter used in the toner scattering prevention apparatus and an operational life of the filter.

Referring now to FIG. 3, a relationship between an area of an air filter 74 or 75 and an operational life of the filters is illustrated. As shown, the larger the area of the air filter 74 or 75, the longer the operational life of the filters. Accordingly, as shown by a dotted line F, if an optimal area of the air filter 74 or 75 is selected to have an operational life corresponding to an operational lifetime of another part, the maintenance intervals for the air filters and other parts may be substantially the same.

As a result, the operational lifetimes of the air filters 74 and 75 may be set to not expire before the operational lifetime of the other parts, which are simultaneously to be replaced. In addition, the air filters 74 and 75 having the predetermined operational lives are not prematurely. Thus, the maintenance cost may be decreased.

A monochrome copier in which a toner image formed on a PC member 10 is directly transferred to a sheet serving as a transfer member, for example, can be used in the above-described example. However, the present invention is not limited thereto and can be applied to the other types of an image forming apparatus, such as a printer, a facsimile, etc., in a similar manner. Further, a color image forming apparatus, in which a toner image formed on an image bearer is temporary transferred onto a medium transfer member, and is transferred therefrom onto a sheet, may also similarly be used in the present invention.

Figure 4:
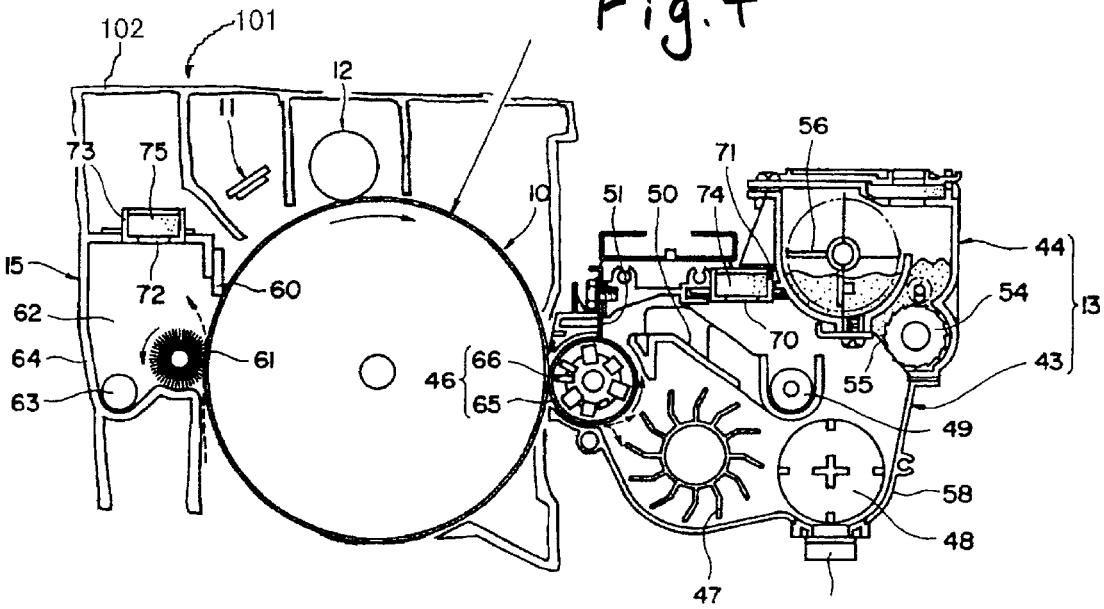
FIG. 4 is a side view illustrating various processing units integrated in a body together with a PC drum and employing a toner scattering prevention apparatus according to the present invention.
Figure 5:
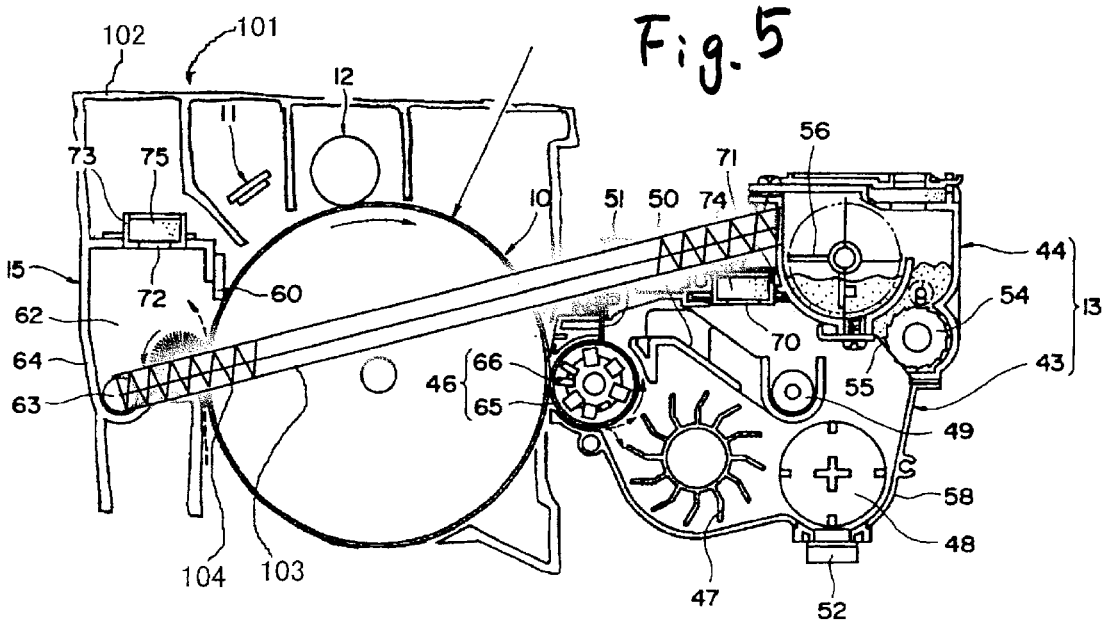
FIG. 5 is a side view illustrating a recycle type image forming apparatus employing a toner scattering prevention apparatus according to the present invention.

With reference to FIGS. 4 and 5, an alternate embodiment is described. As illustrated in FIG. 4, the above-described respective processing devices 11, 13, 14, 15 may be integrated together with the PC drum 140 in a casing 101 as a process cartridge so as to be integrally attached and discarded. However, the process cartridge can only include one of the processing devices 11, 13, 14, 15 and the PC drum 10. The process cartridge may also include the entire PC drum 10, charging apparatus 12, developing apparatus 13 and cleaning apparatus 15 in a body.

FIG. 5 illustrates a recyclable type image forming apparatus. A recovery screw 63 is provided so as to transfer collected toner in the cleaning tank 62 toward the front side of the cleaning apparatus 15. A toner recycle pipe 103 is provided to connect at one end the recovery screw 63 and at another end to the developing device 13. A transfer coil is also provided in the toner recycle pipe 103 so as to receive driving force from a driving device (not shown) and rotate to transfer the collected toner to the developing apparatus 13. The recycled toner is blended with fresh toner in the developing apparatus and serves as developer used in the developing process. While blending the toner, air can also be transferred in the developing device 13, and the internal air pressure can further rise. However, the filteres according to the present invention, lower the excessive internal pressure.

Obviously, numerous additional modifications and variations of the present invention are possible in light of the above teachings. It is therefore to be understood that within the scope of the appended claims, the present invention may be practiced otherwise than as specifically described herein.

What is claimed is:

1. An image forming apparatus, comprising:

a developing apparatus configured to apply toner to a latent image formed on an image bearer;

a cleaning apparatus configured to remove the toner remaining on the image bearer after a toner image is transferred to a transfer medium; and a toner scattering prevention apparatus configured to prevent toner scattering and including a pair of substantially similar air filters detachably attached to air draining openings respectively formed on the developing and cleaning apparatuses.

2. The image forming apparatus according to claim 1, wherein said developing and cleaning apparatuses have substantially similar internal pressures and toner scattering levels.

3. The image forming apparatus according to claim 2, wherein said pair of air filters are maintained at substantially similar time intervals.

4. The image forming apparatus according to claim 2, wherein a lifetime operation of the pair of air filters is selected such that maintenance intervals of the air filters and at least one consumable part in the developing and cleaning apparatuses are substantially similar.

5. The image forming apparatus according to claim 3, wherein a lifetime operation of the pair of air filters is selected such that maintenance intervals of the air filters and at least one consumable part in the developing and cleaning apparatuses are substantially similar.

6. A toner scattering prevention apparatus, comprising:

a pair of substantially similar air filters configured to be detachably attached to air draining openings respectively formed on developing and cleaning apparatuses in an image forming apparatus.

7. The toner scattering apparatus according to claim 6, wherein said developing and cleaning apparatuses have substantially similar internal pressures and toner scattering levels.

8. The toner scattering apparatus according to claim 7, wherein said pair of air filters are maintained at substantially similar time intervals.

9. The toner scattering apparatus according to claim 7, wherein a lifetime operation of the pair of air filters is selected such that maintenance intervals of the air filters and at least one consumable part in the developing and cleaning apparatuses are substantially similar.

10. The toner scattering apparatus according to claim 8, wherein a lifetime operation of the pair of air filters is selected such that maintenance intervals of the air filters and at least one consumable part in the developing and cleaning apparatuses are substantially similar.

11. A method for preventing toner scattering in an image forming apparatus, comprising:

designing internal air pressures and toner scattering levels of respective developing and cleaning devices to be substantially the same;

forming a latent image on an image bearer;

developing the latent image using the developing device;

transferring the toner image onto a transfer medium;

removing and collecting the toner remaining on the image bearer using the cleaning device;

providing air draining openings on the respective developing and cleaning apparatuses; and detachably attaching a pair of substantially similar air filters to the respective air draining openings so to prevent toner scattering.

12. The method according to claim 11, wherein said pair of air filters are maintained at substantially similar time intervals.

13. The method according to claim 11, further comprising selecting a lifetime operation of the pair of air filters such that maintenance intervals of the air filters and at least one consumable part in the developing and cleaning apparatuses are substantially similar.

14. An image forming system, comprising:

developing means for applying toner to a latent image formed on an image bearer;

cleaning means for removing the toner remaining on the image bearer after a toner image is transferred to a transfer medium; and toner scattering prevention means for preventing toner scattering and including a pair of substantially similar air filter means detachably attached to air draining openings respectively formed on the developing and cleaning means.

15. The system according to claim 14, wherein said developing and cleaning means have substantially similar internal pressures and toner scattering levels.

16. The system according to claim 15, wherein said pair of air filter means are maintained at substantially similar time intervals.

17. The system according to claim 16, wherein a lifetime operation of the pair of air filter means is selected such that maintenance intervals of the air filter means and at least one consumable part in the developing and cleaning means are substantially similar.

18. The system according to claim 15, wherein a lifetime operation of the pair of air filter means is selected such that maintenance intervals of the air filter means and at least one consumable part in the developing and cleaning means are substantially similar.

* * * * *